US009951772B2

(12) United States Patent
Duppert et al.

(10) Patent No.: US 9,951,772 B2
(45) Date of Patent: Apr. 24, 2018

(54) SCROLL COMPRESSOR WITH UNMACHINED SEPARATOR PLATE AND METHOD OF MAKING SAME

(71) Applicants: Ronald J. Duppert, Fayetteville, NY (US); Kurt William Robert Bessel, Mexico, NY (US)

(72) Inventors: Ronald J. Duppert, Fayetteville, NY (US); Kurt William Robert Bessel, Mexico, NY (US)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 177 days.

(21) Appl. No.: 14/841,263

(22) Filed: Aug. 31, 2015

(65) Prior Publication Data

US 2016/0369798 A1 Dec. 22, 2016

Related U.S. Application Data

(63) Continuation-in-part of application No. 14/743,114, filed on Jun. 18, 2015.

(51) Int. Cl.

| | |
|---|---|
| ***F01C 1/02*** | (2006.01) |
| ***F04C 18/02*** | (2006.01) |
| ***F04C 23/00*** | (2006.01) |

(52) U.S. Cl.

CPC ..... *F04C 18/0215* (2013.01); *F04C 23/008* (2013.01); *F04C 2230/60* (2013.01); *F04C 2240/30* (2013.01); *F04C 2240/52* (2013.01)

(58) Field of Classification Search

CPC ..... F04C 18/0215; F04C 2230/60; F04C 2240/30; F04C 2240/52; F04C 23/008

See application file for complete search history.

(56) References Cited

U.S. PATENT DOCUMENTS

| | | | | |
|---|---|---|---|---|
| 6,171,084 | B1 | 1/2001 | Wallis et al. | |
| 6,203,298 | B1 * | 3/2001 | Scarfone | F01C 21/10 418/149 |
| 6,398,530 | B1 | 6/2002 | Hasemann | |
| 6,428,292 | B1 | 8/2002 | Wallis et al. | |

(Continued)

FOREIGN PATENT DOCUMENTS

CN 101614205 A 12/2009

*Primary Examiner* — Jesse Bogue

(74) *Attorney, Agent, or Firm* — Reinhart Boerner Van Deuren P.C.

(57) ABSTRACT

A scroll compressor includes scroll compressor bodies, which, in turn, include a fixed scroll compressor body and a moveable scroll compressor body. The scroll compressor bodies have respective bases and respective scroll ribs that project from the respective bases, and which mutually engage about an axis for compressing fluid. The scroll compressor also includes a housing to house the scroll compressor bodies. A separator plate is configured to separate a high-pressure gas chamber from a low-pressure gas chamber within the housing. The separator plate has no machined surfaces, and has an outer perimeter portion which is attached to an unmachined inner surface of the housing. Having no machined surfaces indicates that no material is removed from the separator plate during its manufacture apart from operations to form initial inner and outer diameters of the separator plate.

17 Claims, 8 Drawing Sheets

(56) References Cited

U.S. PATENT DOCUMENTS

| | | | | |
|---|---|---|---|---|
| 6,485,256 | B1 * | 11/2002 | Iketani | F04D 29/0462 277/394 |
| 6,582,211 | B2 | 6/2003 | Wallis et al. | |
| 6,814,551 | B2 | 11/2004 | Kammhoff et al. | |
| 6,960,070 | B2 * | 11/2005 | Kammhoff | F04C 29/126 184/6.18 |
| 7,112,046 | B2 | 9/2006 | Kammhoff et al. | |
| 7,997,877 | B2 | 8/2011 | Beagle et al. | |
| 8,133,043 | B2 | 3/2012 | Duppert | |
| 8,167,595 | B2 | 5/2012 | Duppert | |
| 9,145,889 | B2 * | 9/2015 | Kim | F01C 21/10 |
| 2002/0114720 | A1 | 8/2002 | Itoh et al. | |
| 2003/0198566 | A1 * | 10/2003 | Dewar | F04C 23/008 418/55.2 |
| 2006/0228243 | A1 * | 10/2006 | Sun | F04C 23/008 418/55.1 |
| 2013/0251575 | A1 * | 9/2013 | Roof | F04C 23/008 418/55.4 |
| 2015/0291905 | A1 * | 10/2015 | Takahashi | F01D 11/003 508/107 |
| 2016/0369803 | A1 * | 12/2016 | Bessel | F04C 29/0092 |

* cited by examiner

SCROLL COMPRESSOR WITH UNMACHINED SEPARATOR PLATE AND METHOD OF MAKING SAME

CROSS-REFERENCE TO RELATED PATENT APPLICATIONS

This patent application is a continuation-in-part of co-pending U.S. patent application Ser. No. 14/743,114, filed Jun. 18, 2015, the entire teachings and disclosure of which are incorporated herein by reference thereto.

FIELD OF THE INVENTION

This invention generally relates to scroll compressor, components of scroll compressors and methods of manufacturing the same.

BACKGROUND OF THE INVENTION

A scroll compressor is a certain type of compressor that is used to compress refrigerant for such applications as refrigeration, air conditioning, industrial cooling and freezer applications, and/or other applications where compressed fluid may be used. Such prior scroll compressors are known, for example, as exemplified in U.S. Pat. No. 6,398,530 to Hasemann; U.S. Pat. No. 6,814,551, to Kammhoff et al.; U.S. Pat. No. 6,960,070 to Kammhoff et al.; U.S. Pat. No. 7,112,046 to Kammhoff et al.; and U.S. Pat. No. 7,997,877, to Beagle et al., all of which are assigned to a Bitzer entity closely related to the present assignee. As the present disclosure pertains to improvements that can be implemented in these or other scroll compressor designs, the disclosures of U.S. Pat. Nos. 6,398,530, 7,112,046, 6,814,551, and 6,960,070 are hereby incorporated by reference in their entireties.

Additionally, particular embodiments of scroll compressors are disclosed in U.S. Pat. No. 6,582,211 to Wallis et al., U.S. Pat. No. 6,428,292 to Wallis et al., and U.S. Pat. No. 6,171,084 to Wallis et al., the teachings and disclosures of which are hereby incorporated by reference in their entireties.

As is exemplified by these patents, scroll compressors conventionally include an outer housing having a scroll compressor contained therein. A scroll compressor includes first and second scroll compressor members. A first compressor member is typically arranged stationary and fixed in the outer housing. (It is noted stationary and fixed include non-orbiting compressor members that may be compliantly mounted in the housing shell). A second scroll compressor member is moveable relative to the first scroll compressor member in order to compress refrigerant between respective scroll ribs which rise above the respective bases and engage in one another. Conventionally the moveable scroll compressor member is driven about an orbital path about a central axis for the purpose of compressing refrigerant. An appropriate drive unit, typically an electric motor, is usually provided within the same housing to drive the movable scroll member.

In conventional compressors, for example scroll compressors, a separator plate may be used to separate high-pressure regions from low-pressure regions. Typically, these separator plates include a central bore which is machined after the separator plate is stamped. This machining allows for looser position tolerances during final assembly. However, this machining adds cost, additional complexity, and additional time to the manufacturing process.

Embodiments of the invention address certain of the aforementioned problems encountered during the manufacture of compressors, particularly, scroll compressors. These and other advantages of the invention, as well as additional inventive features, will be apparent from the description of the invention provided herein.

BRIEF SUMMARY OF THE INVENTION

In one aspect, embodiments of the invention provide a method of manufacturing a scroll compressor that includes assembling scroll compressor bodies having respective bases and respective scroll ribs that project from the respective bases and which mutually engage about an axis for compressing fluid. The method further includes assembling a housing shell section over the scroll compressor bodies, and constructing a separator plate. Constructing a separator plate may include piercing an inner portion of a metal blank of substantially constant thickness and trimming a perimeter portion of the metal blank, to form an annular member. Constructing a separator plate also includes forming the annular member into a frusto-conical shape having an axially-extending curved outer wall, and a central opening having an axially-extending curved inner wall. No surface of the annular member is machined. The method also involves press-fitting the separator plate into the housing, attaching the axially-extending curved outer wall to an unmachined inner surface of the housing shell section, and assembling the axially-extending curved inner wall to a central hub of one of the scroll compressor bodies.

In the context of this application, the term "unmachined" is used with respect to processes that do not remove any material from the separator plate. Typically, a separator plate of the type discussed herein is trimmed on the outside to form an initial outer diameter for the separator plate, and an inner portion is pierced to make a hole to form an initial inner diameter for the separator plate. The aforementioned "trimming" and "piercing" may be carried out using a variety of processes, including, but not limited to, cutting, sawing, shearing, stamping, punching, torching, laser cutting, etc. Each of these "trimming" and "piercing" steps run substantially parallel to the thickness of the blank material. These operations are undertaken to form an initial inner and outer diameter for the separator plate are excluded from consideration in terms of the meaning of "unmachined" as used herein. More specifically, the term "unmachined" is used to indicate that no material is removed by the shaping and forming processes used to make the separator plate, outside of the aforementioned "trimming" and "piercing" steps.

Conversely, the term "machined", as used herein, refers to processes where material is removed from the part being processed. As such, in the context of this application, an "unmachined" separator plate is one in which no material has been removed from the starting metal blank outside of the step used to create the central opening of the separator plate, and the step used to define the perimeter of the separator plate. More specifically, the term "unmachined" indicates that any of the shaping, forming, drawing, and finishing operations, used to manufacture the separator plate, remove no material therefrom.

In a particular embodiment of the invention, the piercing step and the trimming step are performed simultaneously by stamping the metal blank to form the annular member such that an outer diameter and an inner diameter of the annular member are formed simultaneously by the stamping operation, which results in a central opening whose inner diameter is precisely aligned with the outer diameter. In alternate embodiments, the piercing step is performed at some point during the manufacturing after initial forming, but prior to creating the cylindrical central bore. In additional alternate embodiments, the trim may be performed on a similarly semi-finished part, prior to forming the axially-extending curved outer wall.

In a particular embodiment, the method calls for welding the axially-extending curved outer wall to the unmachined inner surface of the housing shell section. In some embodiments, the method requires forming a central opening having an axially-extending curved inner wall having a cylindrical portion. In a further embodiment, constructing a separator plate includes constructing a separator plate having a substantially constant thickness. In a more particular embodiment, the method includes forming the stamped annular member with a substantially constant thickness between 2.5 and 10 mm. It should be understood that this range is a range for the nominal overall thickness of the separator plate and does not speak at all to any variability in this nominal thickness of the separator plate.

In another aspect, embodiments of the invention provide a method for manufacturing a separator plate having no machined surfaces, where the separator plate is used in a scroll compressor. The term "machined" is used in to indicate some degree of material removal. Thus, the phrase, "machined surfaces", refers to surfaces in which manufacturing processes remove at least some of the surface material. The method calls for piercing an inner portion of a metal blank of substantially constant thickness and trimming a perimeter portion of the metal blank, to form an annular member. The method also includes forming the annular member into a frusto-conical shape having an axially-extending curved outer wall, and a central opening having an axially-extending curved inner wall. The formed annular member has a substantially constant thickness. In certain embodiments, stamping a flat metal blank of substantially constant thickness is done on a hard tool configured to restrain movement of the flat metal blank.

In certain embodiments of the invention, the inner diameter piercing step and the outer diameter trimming step are performed simultaneously by stamping the metal blank to form the annular member such that an outer diameter and an inner diameter of the annular member are formed simultaneously by the stamping operation, which results in a central opening whose inner diameter is precisely aligned with the outer diameter. In alternate embodiments, the inner diameter piercing step is performed after the initial forming of the annular member into a frusto-conical shape, but before forming the axially extending curved inner wall. In some embodiments, stamping the metal blank to form the annular member such that the outer diameter and the inner diameter of the annular member are formed simultaneously comprises stamping the metal blank on a hard tool configured to restrain movement of the metal blank.

In a particular embodiment, forming the stamped annular member with a central opening having an axially-extending curved inner wall includes the step of forming the stamped annular member with a central opening having an axially-extending curved inner wall having a cylindrical portion.

In yet another aspect, embodiments of the invention provide a scroll compressor that includes scroll compressor bodies including a fixed scroll compressor body and a moveable scroll compressor body. The scroll compressor bodies have respective bases and respective scroll ribs that project from the respective bases and which mutually engage about an axis for compressing fluid. The scroll compressor has a housing to house the scroll compressor bodies. A separator plate is configured to separate a high-pressure gas chamber from a low-pressure gas chamber within the housing. The separator plate has no machined surfaces, and has an outer perimeter portion which is attached to an unmachined inner surface of the housing. Having no machined surfaces indicates that no material is removed from the separator plate during its manufacture apart from operations to form initial inner and outer diameters of the separator plate.

In certain embodiments, the outer perimeter portion of the separator plate is welded to the unmachined inner surface of the housing. The separator plate has a central opening with an axially-extending curved inner wall configured to receive a central hub of the fixed scroll body. In some embodiments, the separator plate has a substantially constant thickness. In some embodiments, at least a portion of the separator plate is frusto-conical, and the outer perimeter is an axially-extending curved outer wall. In certain embodiments, the separator plate has a substantially constant thickness of between 2.5 and 10 mm. It should be understood that this range is a range for the nominal overall thickness of the separator plate and does not speak at all to any variability in this nominal thickness of the separator plate.

In a further embodiment, the separator plate includes a first surface and a second surface with a substantially constant thickness defined therebetween, the first and second surfaces extending radially inward from an outer annular end surface toward an inner annular end surface, the outer and inner annular end surfaces each joining the first and second surfaces and extending transversely between the first and second surfaces a distance that is equal to the substantially constant thickness.

The term "substantially constant" thickness, as used herein, indicates that the part being referred to may include some amount of localized thinning or thickening as a result of the metal forming process, as such behavior is present to some extent in all drawn metal parts. Localized thinning or thickening are a result of tooling geometry, and may not be tailored such that the greatest extent of thickening occurs at the high stress locations where it would be beneficial. On the contrary, stamped parts often thin at the locations of relatively higher stress, such as transitions and corners. Further machining near these locations may necessitate a thicker stock material to achieve sufficient final thickness in high-stress locations. In some embodiments, maximum thickness of the separator plate 30 is no more than 40% greater than its minimum thickness. Further, in a preferable embodiment, the "substantially constant" thickness is one in which the maximum thickness is up to 5% greater than the minimum thickness. In other embodiments, the "substantially constant" thickness is one in which the maximum thickness is up to 10% greater than the minimum thickness.

In some embodiments, the first and second surfaces are smooth being free of any steps formed into the first and second surfaces. In a particular embodiment, the separator plate includes an innermost diameter defined by a cylindrical sealing section, wherein the cylindrical sealing section receives and engages a slideable radial seal carried by the fixed scroll compressor body, the cylindrical section being delimited along a bottom thereof by an outward flare terminating in the inner annular end surface, and delimited along a top portion thereof by a curved annular nose region that merges into a connecting annular wall portion that joins the outer perimeter portion. Further, the connecting annular wall portion may include a frusto-conical wall portion and axially-extending wall portion joint at an outer annular bend, the frusto-conical wall portion extending radially between the curved annular nose region and the axially-extending wall, the axially-extending wall extending vertically below the frusto-conical wall portion, and the outer annular end surface being at least partially covered by an annular weld that joins the housing and the separator plate.

In particular embodiments, the cylindrical sealing section has a surface finish, or surface roughness, of between 0.2 and 1.0 μm Ra. Such a surface quality is costly and difficult to obtain with a lathe-turned part. In certain embodiments, the process for manufacturing the separator plate includes an additional forming or shaping operation on the inner and outer diameters. This additional forming or shaping operation operates as a non-material-removal finishing step that instead displaces material locally within the part to achieve a smoother surface, such as burnishing or ironing. Such a process achieves a high-quality surface finish without removing any surface material from the separator plate, and may produce a non-abrasive surface as low as 0.6 μm Ra on both inner and outer diameter sections, which, in addition to being faster and less expensive, results in a better surface finish and position than in many typical high volume machining operations.

More generally, the aforementioned non-material-removal finishing step process typically results in a separator plate that includes an inner diameter defined by a cylindrical sealing section with an inner sealing surface having a surface roughness of less than 1.0 μm Ra, and, in other embodiments, the outer perimeter portion of the separator plate has an axially-extending curved outer wall with a surface roughness of less than 1.0 μm Ra. Some embodiments may have a cylindrical sealing surface with a circularity of 0.15 mm or more, which is substantially more than a machined component of similar scale. The process described herein, i.e., the simultaneous formation of the central bore, or central opening, that forms the inner diameter, and of the outer diameter allows for the central opening to be positioned with such precision that some error in circularity can be tolerated.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
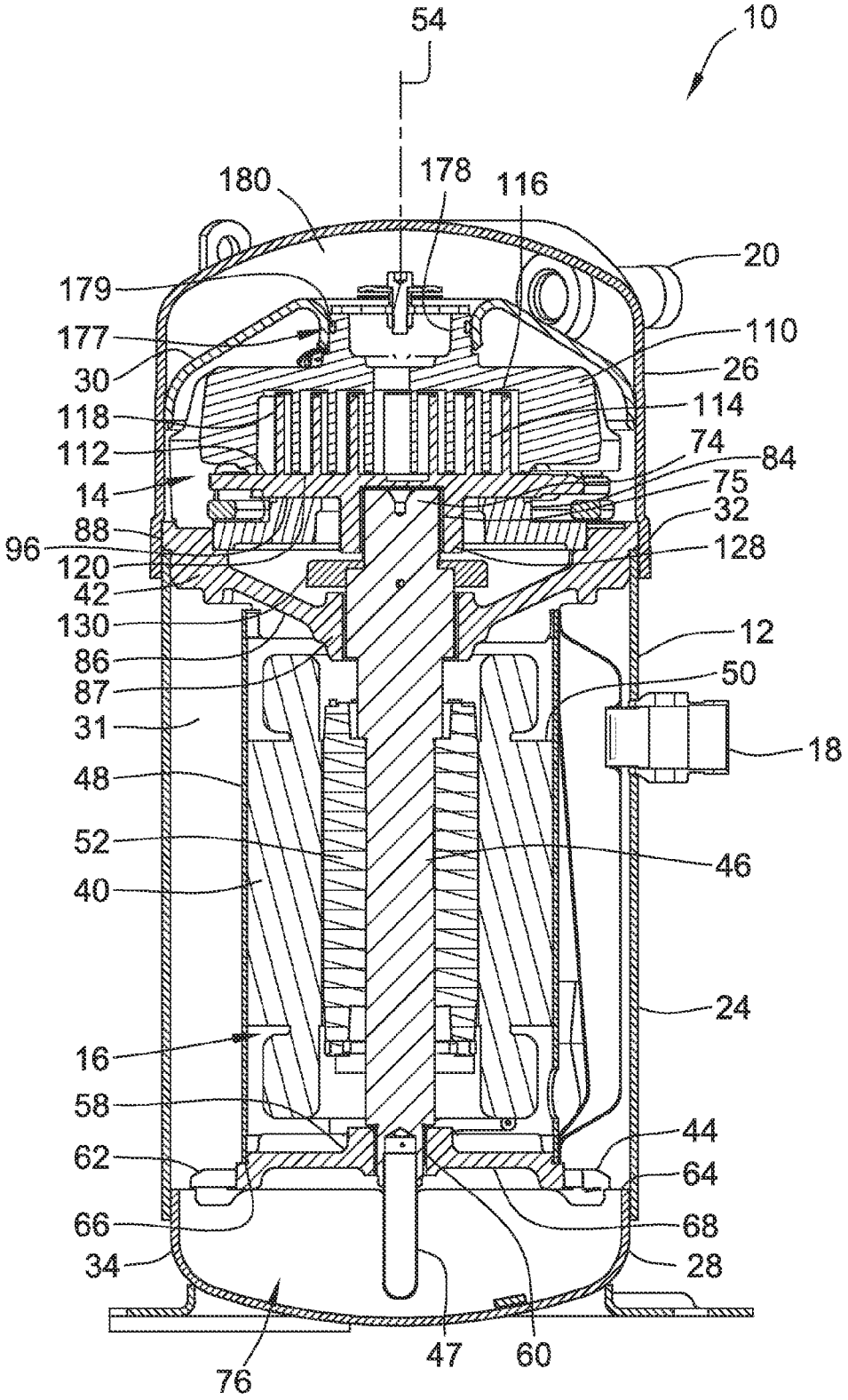
FIG. 1 is a cross-sectional isometric view of a scroll compressor assembly, according to an embodiment of the invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

An embodiment of the present invention is illustrated in FIGS. 1-4 as a scroll compressor assembly 10 generally including an outer housing 12 in which a scroll compressor 14 can be driven by a drive unit 16. The scroll compressor assembly 10 may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The scroll compressor assembly 10 is operable through operation of the drive unit 16 to operate the scroll compressor 14 and thereby compress an appropriate refrigerant or other fluid that enters the refrigerant inlet port 18 and exits the refrigerant outlet port 20 in a compressed high-pressure state.

The outer housing 12 for the scroll compressor assembly 10 may take many forms. In particular embodiments of the invention, the outer housing 12 includes multiple shell sections. In the embodiment of FIG. 1, the outer housing 12 includes a central cylindrical housing section 24, and a top end housing section 26, and a bottom end housing section 28. In certain embodiments, the housing sections 24, 26, 28 are formed of appropriate sheet steel and welded together to make a permanent outer housing 12 enclosure. However, if disassembly of the housing is desired, other housing assembly provisions can be made that can include metal castings or machined components, wherein the housing sections 24, 26, 28 are attached using fasteners.

As can be seen in the embodiment of FIG. 1, the central housing section 24 is cylindrical, joined with the top end housing section 26. In this embodiment, a separator in the form of separator plate 30 is disposed in the top end housing section 26. Each of the top and bottom end housing sections 26, 28 are generally dome shaped and include respective cylindrical side wall regions 32, 34 that assemble to the center section 24 and provide for closing off the top and bottom ends of the outer housing 12. As can be seen in FIG. 1, the top side wall region 32 telescopically overlaps the central housing section 24 and is exteriorly welded along a circular welded region to the top end of the central housing section 24. Similarly, a bottom portion of the central cylindrical housing section 24 overlaps the side wall region 34.

During assembly, these components may be assembled such that a single circumferential weld around the inner surface of the outer housing 12 joins the top end housing section 26 and the separator plate 30. A second circumferential weld may externally join the top end housing section 26 and central cylindrical housing section 24. In particular embodiments, the central cylindrical housing section 24 is welded to the bottom shell 28, though, as stated above, alternate embodiments would include other methods of joining (e.g., fasteners) these sections of the outer housing 12.

Assembly of the outer housing 12 results in the formation of an enclosed chamber 31 that surrounds the drive unit 16, and partially surrounds the scroll compressor 14. In particular embodiments, the top end housing section 26 is generally dome-shaped and includes a respective cylindrical side wall region 32 that fits telescopically with the top of the central cylindrical housing section 24, and provides for closing off the top end of the outer housing 12.

In a particular embodiment, the drive unit 16 in is the form of an electrical motor assembly 40. The electrical motor assembly 40 operably rotates and drives a shaft 46. Further, the electrical motor assembly 40 generally includes an outer annular motor housing 48, a stator 50 comprising electrical coils and a rotor 52 that is coupled to the drive shaft 46 for rotation together. In a particular embodiment, the rotor 52 is mounted on the drive shaft 46, which is supported by upper and lower bearing members 42, 44. Energizing the stator 50 is operative to rotatably drive the rotor 52 and thereby rotate the drive shaft 46 about a central axis 54.

Applicant notes that when the terms "axial" and "radial" are used herein to describe features of components or assemblies, they are defined with respect to the central axis 54. Specifically, the term "axial" or "axially-extending" refers to a feature that projects or extends in a direction generally parallel to the central axis 54, while the terms "radial' or "radially-extending" indicates a feature that projects or extends in a direction generally perpendicular to the central axis 54. Some minor variation from parallel and perpendicular is permissible.

Figure 4:
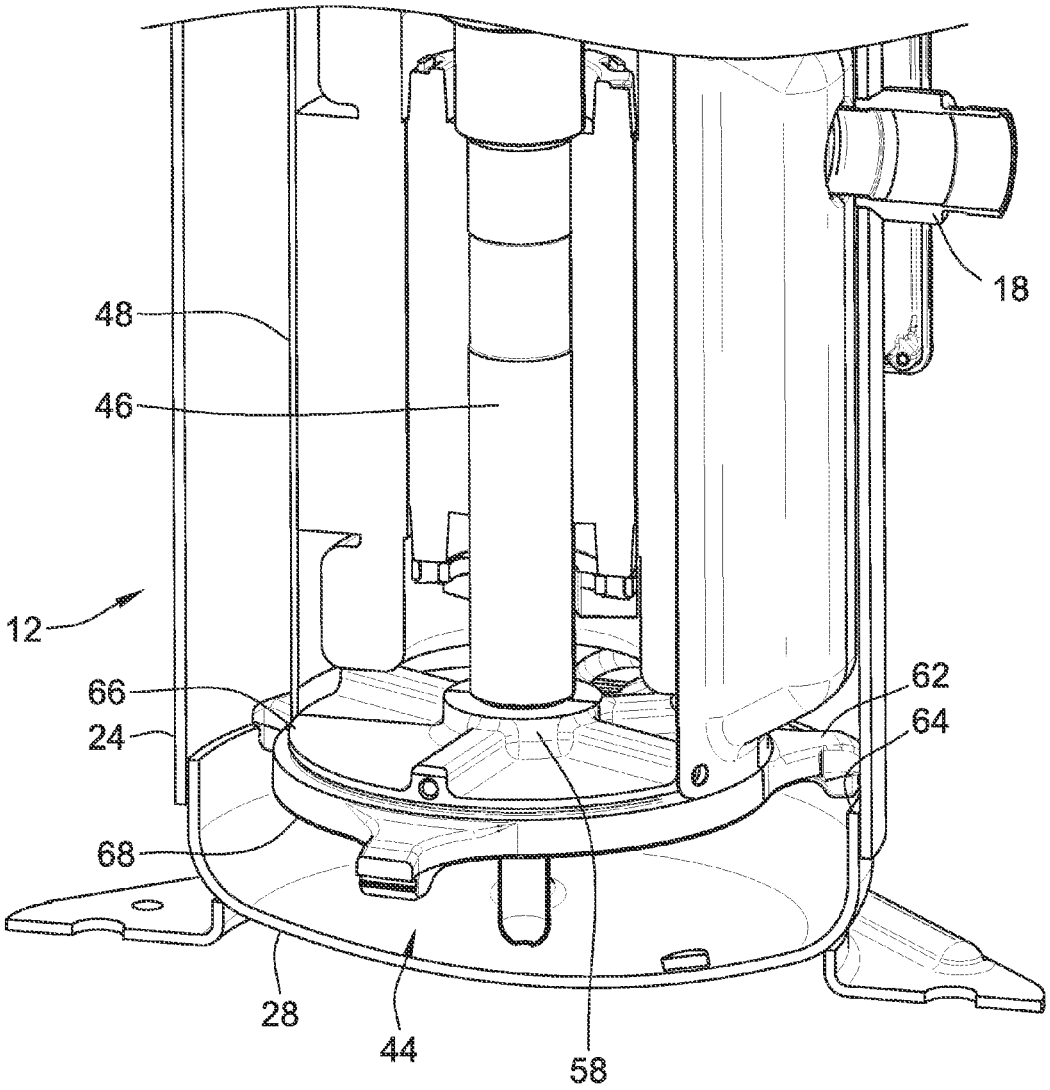
FIG. 4 is a cross-sectional isometric view of a lower portion of the scroll compressor assembly of FIG. 1

With reference to FIGS. 1 and 4, the lower bearing member 44 includes a central generally cylindrical hub 58 that includes a central bushing and opening to provide a cylindrical bearing 60 to which the drive shaft 46 is journaled for rotational support. A plurality of arms 62 and typically at least three arms project radially outward from the bearing central hub 58 preferably at equally spaced angular intervals. These support arms 62 engage and are seated on a circular seating surface 64 provided by the terminating circular edge of the bottom side wall region 34 of the bottom outer housing section 28. As such, the bottom housing section 28 can serve to locate, support and seat the lower bearing member 44 and thereby serves as a base upon which the internal components of the scroll compressor assembly can be supported.

Referring to FIG. 4, the lower bearing member 44 in turn supports the cylindrical motor housing 48 by virtue of a circular seat 66 formed on a plate-like ledge region 68 of the lower bearing member 44 that projects outward from the central hub 58. The support arms 62 also preferably are closely toleranced relative to the inner diameter of the central housing section 24. The arms 62 may engage with the inner diameter surface of the central housing section 24 to centrally locate the lower bearing member 44 and thereby maintain position of the central axis 54. This can be by way of an interference and press-fit support arrangement between the lower bearing member 44 and the outer housing 12. Alternatively, according to a more preferred configuration shown in FIG. 1, the lower bearing member 44 engages with the lower housing section 28 which is in turn attached to center section 24. Likewise, the outer motor housing 48 may be supported with an interference and press-fit along the stepped seat 66 of the lower bearing member 44. In some embodiments, screws may be used to securely fasten the motor housing 48 to the lower bearing member 44.

The drive shaft 46 further includes an offset eccentric drive section 74 that has a cylindrical drive surface 75 about an offset axis that is offset relative to the central axis 54. This offset drive section 74 is journaled within a cavity of the movable scroll member 112 of the scroll compressor 14 to drive the movable scroll member 112 of the scroll compressor 14 about an orbital path when the drive shaft 46 is rotated about the central axis 54. To provide for lubrication of all of these bearing surfaces, the outer housing 12 provides an oil lubricant sump 76 at the bottom end in which suitable oil lubricant is provided. The drive shaft 46 has an impeller tube 47 that acts as an oil pump when the drive shaft 46 is spun and thereby pumps oil out of the lubricant sump 76 into an internal lubricant passageway 80 within the drive shaft 46. During rotation of the drive shaft 46, centrifugal force acts to drive lubricant oil up through the lubricant passageway 80 against the action of gravity. In a particular embodiment, the lubricant passageway 80 includes various radial passages to feed oil through centrifugal force to appropriate bearing surfaces and thereby lubricate sliding surfaces as may be desired.

Figure 2:
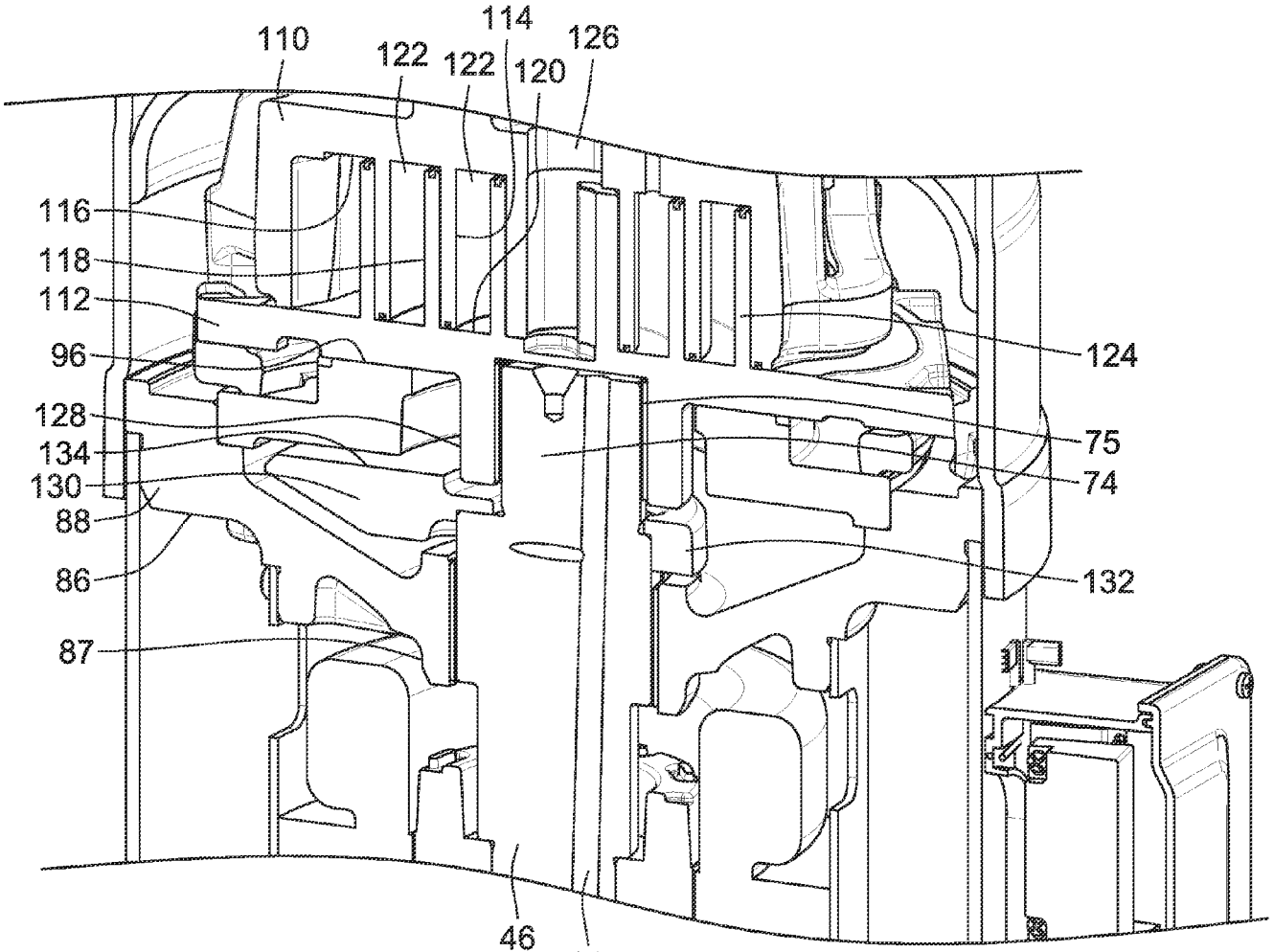
FIG. 2 is a cross-sectional isometric view of an upper portion of the scroll compressor assembly of FIG. 1.
Figure 3:
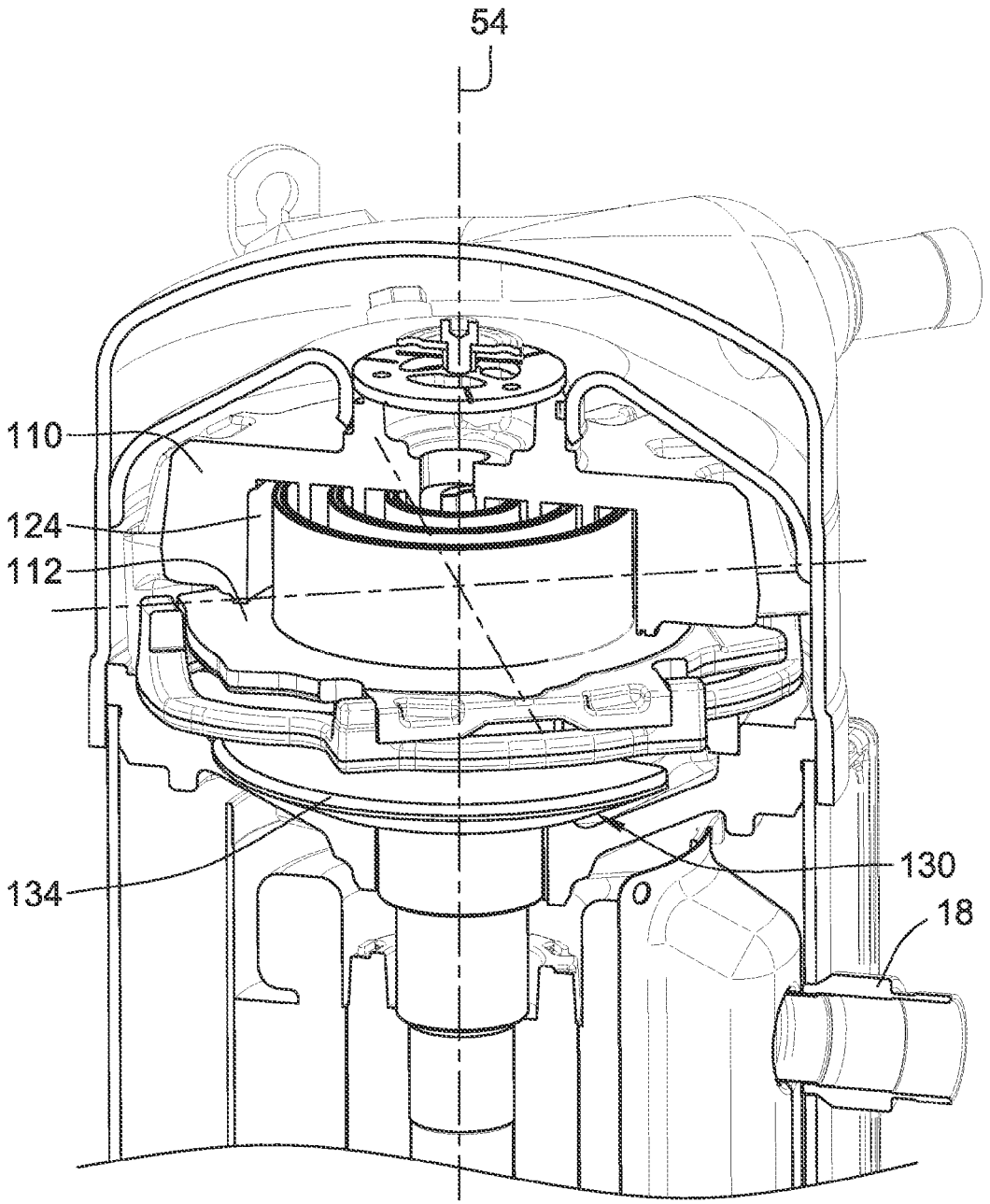
FIG. 3 is a cross-sectional isometric view of a top portion of the scroll compressor assembly of FIG. 1.

The upper bearing member, or crankcase, 42 includes a central bearing hub 87 into which the drive shaft 46 is journaled for rotation. Extending outward from the central bearing hub 87 is a disk-like portion 86 that terminates in an intermittent perimeter support surface 88. In the embodiments of FIGS. 2 and 3, the central bearing hub 87 extends below the disk-like portion 86, while a thrust bearing 84 is assembled above the disk-like portion 86 and contains a thrust surface 96, which provides axial support for the moveable scroll compressor body 112. In certain embodiments, the intermittent perimeter support surface 88 is adapted to have an interference and press-fit with the outer housing 12. It is understood that alternate embodiments of the invention may include crankcase posts with threaded holes to receive fasteners for assembly. Alternate embodiments of the invention also include those in which the posts are integral with a pilot ring instead of the crankcase.

Turning in greater detail to the scroll compressor 14, the scroll compressor body is provided by first and second scroll compressor bodies which preferably include a relatively stationary fixed scroll compressor member 110 and a second scroll compressor member 112 movable relative to the fixed scroll compressor member 110. While the term "fixed" generally means stationary or immovable in the context of this application, more specifically "fixed" refers to the non-orbiting, non-driven scroll member, as it is acknowledged that some limited range of axial, radial, and rotational movement is possible due to thermal expansion and/or design tolerances, and for example, includes compliant mounted compressor members.

The second scroll compressor member 112 is arranged for orbital movement relative to the fixed scroll compressor member 110 for the purpose of compressing refrigerant. The fixed scroll compressor member 110 includes a first rib 114 projecting axially from a plate-like base 116 and is designed in the form of a spiral. Similarly, the second movable scroll compressor body 112 includes a second scroll rib 118 projecting axially from a plate-like base 120 and is in the design form of a similar spiral.

The scroll ribs 114, 118 engage in one another and abut sealingly on the respective base surfaces 120, 116 of the respectively other compressor body 112, 110. As a result, multiple compression chambers 122 are formed between the scroll ribs 114, 118 and the bases 120, 116 of the respective compressor bodies 112, 110. Within the chambers 122, progressive compression of refrigerant takes place. Refrigerant flows with an initial low pressure via an intake area 124 surrounding the scroll ribs 114, 118 in the outer radial region. Following the progressive compression in the chambers 122 (as the chambers progressively are defined radially inward), the refrigerant exits via a discharge port 126 which is defined centrally within the base 116 of the fixed scroll compressor member 110. Refrigerant that has been compressed to a high pressure can exit the chambers 122 via the discharge port 126 during operation of the scroll compressor.

The movable scroll compressor body 112 engages the eccentric offset drive section 74 of the drive shaft 46. More specifically, the receiving portion of the movable scroll compressor body 112 includes a cylindrical bushing drive hub 128 which slideably receives the offset eccentric drive section 74 with a slideable bearing surface provided therein. In detail, the offset eccentric drive section 74 engages the cylindrical drive hub 128 in order to move the second scroll compressor member 112 about an orbital path about the central axis 54 during rotation of the drive shaft 46 about the central axis 54. Considering that this offset relationship causes a weight imbalance relative to the central axis 54, the assembly preferably includes a counter weight 130 that is mounted at a fixed angular orientation to the drive shaft 46.

The counter weight 130 acts to offset the weight imbalance caused by the eccentric offset drive section 74 and the movable scroll compressor body 112 that is driven about an orbital path (e.g. among other things, the scroll rib is not equally balanced). The counter weight 130 includes an attachment collar 132 and an offset weight region 134 that provides for the counter weight effect and thereby balancing of the forces of the rotating components about the central axis 54. This provides for reduced vibration and noise of the overall assembly by internally balancing or canceling out inertial forces.

Referring in greater detail to the fixed scroll compressor member 110, this body 110 is fixed to the upper bearing member 42, capturing the second scroll compressor member 112 between the fixed scroll member 110 and the upper bearing member 42. In a particular embodiment, the fixed scroll compressor body 110, together with the separator plate 30, separates a high pressure chamber 180 from the relatively lower pressure region of the compressor 14 contained within the outer housing 12. The central hub 178 of the fixed scroll compressor 110 body includes a circumferential O-ring groove 177, and when assembled with an O-ring 179, seals against the central cylindrical bore of the separator plate 30, preventing the return of high pressure compressed refrigerant to the relatively lower pressure region of the compressor assembly 14. At the interface between the separator plate 30 and the top end housing section 26, a fillet weld joins the end face of the outer cylindrical wall section of the separator plate 30 with the inside surface of the top end housing section 26, thus preventing the return of high pressure compressed refrigerant to the relatively lower pressure region of the compressor assembly 14.

The fillet weld allows for the separator plate 30 to be assembled to the top end housing section 26 prior to final assembly and weld of the compressor housing 12. This allows for inspection and confirmation of positional alignment between the central axis 54 of the top end housing section 26 and the central cylindrical bore 204 (shown in FIG. 5) of the separator plate 30.

Figure 5:
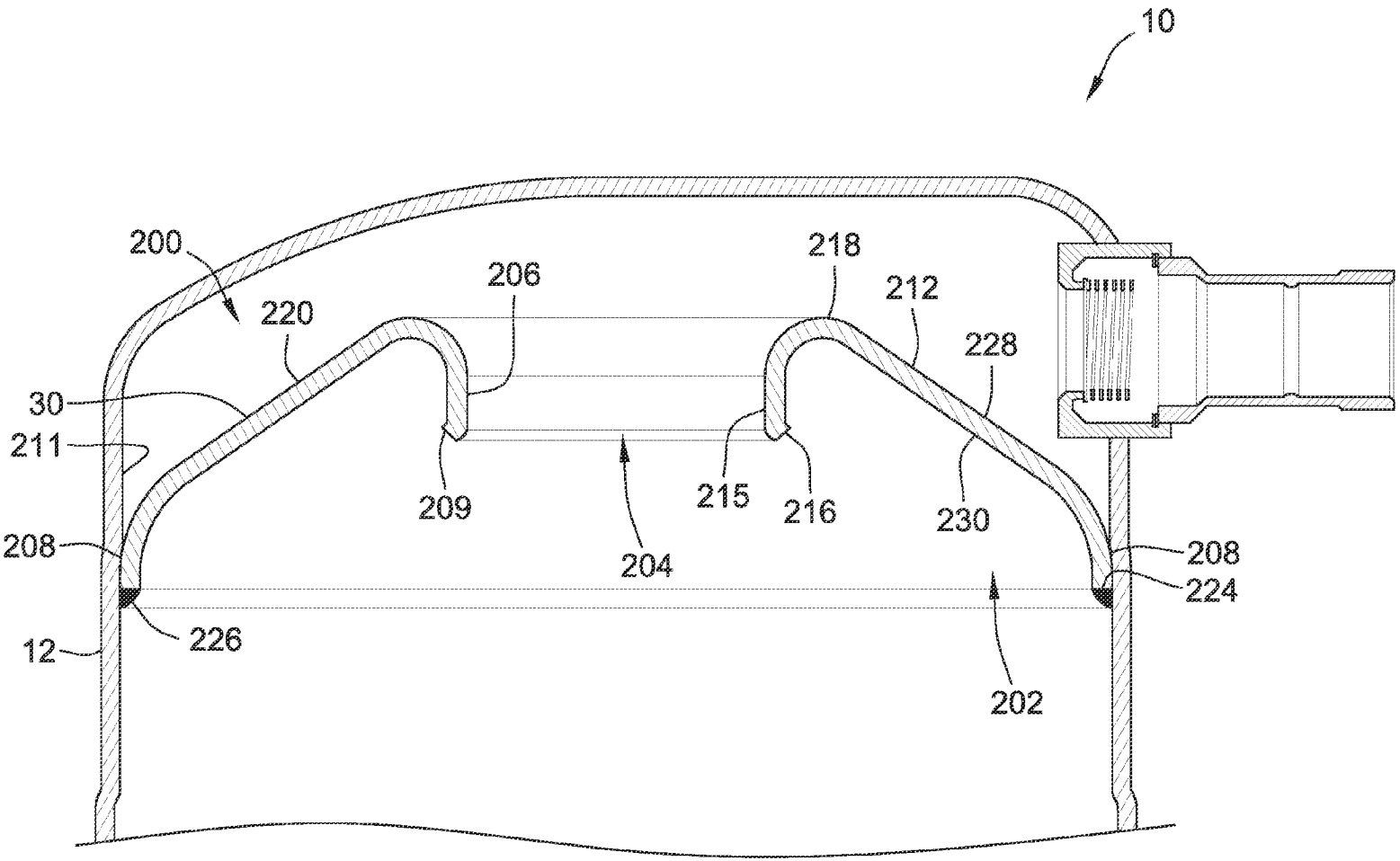
FIG. 5 is a cross-sectional view of the upper portion of a compressor with a separator plate, according to an embodiment of the invention.
Figure 6:
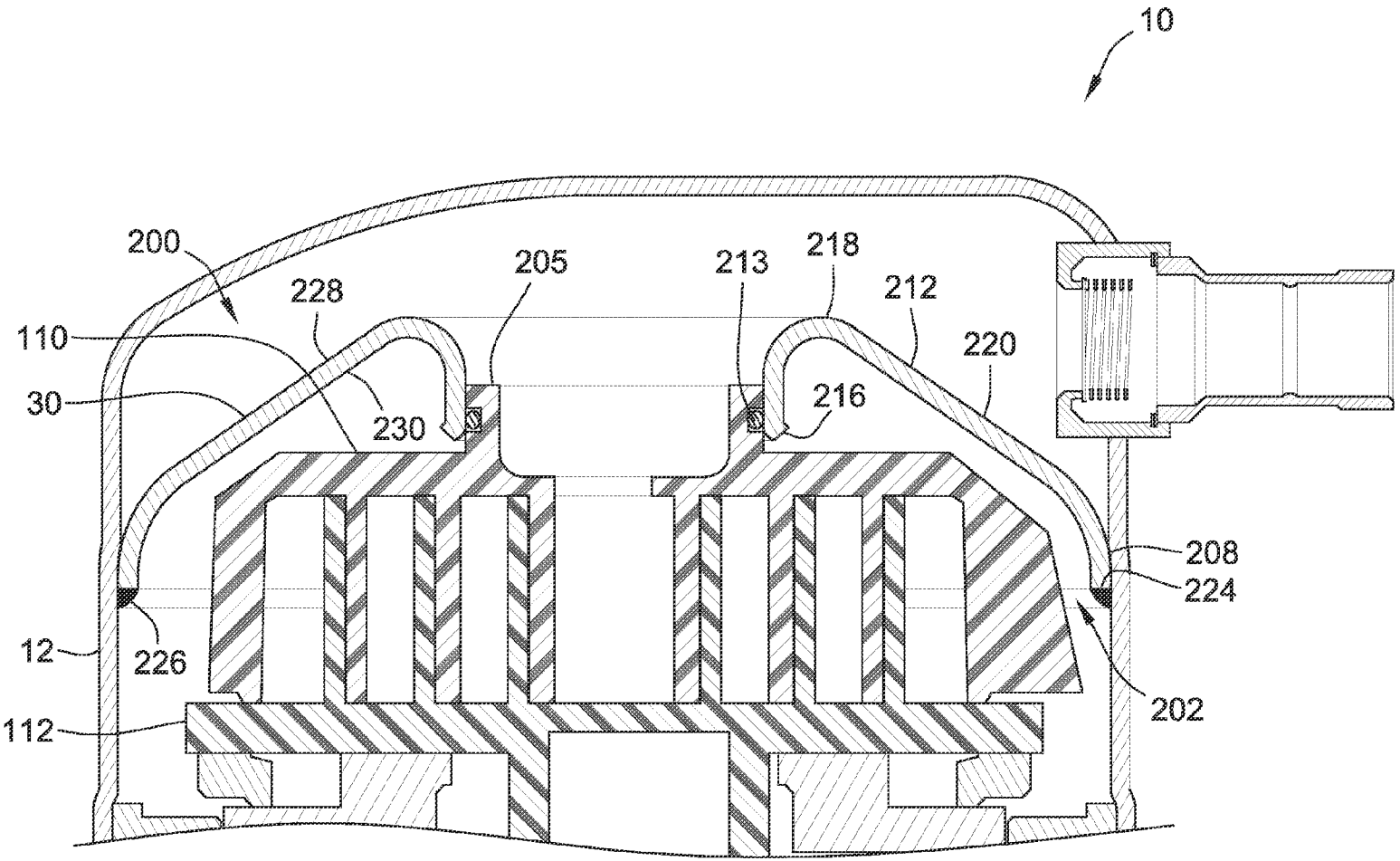
FIG. 6 is a cross-sectional view of the upper portion of a scroll compressor with a separator plate and scroll compressor bodies, according to an embodiment of the invention.

FIG. 5 is a cross-sectional view of the upper portion of a compressor 10 with a separator plate 30, while FIG. 6 is a cross-sectional view of the upper portion of a scroll compressor 10 with a separator plate and scroll compressor bodies 110, 112, in accordance with an embodiment of the invention. The separator plate 30 is disposed in the housing 12 to separate a high-pressure region 200 from a relatively lower pressure region 202. The separator plate 30 has a central opening 204. A perimeter of the central opening 204 is defined by an axially-extending curved inner wall 206. The axially-extending curved inner wall 206 is joined to an axially-extending curved outer wall 208 via an annular plate 212. In the embodiment shown, the axially-extending curved outer wall 208 is located at an outer perimeter of the separator plate 30. In the embodiments of FIGS. 5 and 6, the annular plate 212 is frusto-conical, however other suitable configurations (both curved and flat, for example) for the annular plate 212 are envisioned.

In a particular embodiment such as shown in FIG. 6, the axially-extending curved inner wall 206 is configured to receive a central hub 205 of the fixed scroll compressor body 110. The axially-extending curved inner wall 206 may curve towards the axially-extending curved outer wall 208 at a flared entrance point 209 where the fixed scroll compressor body 110 enters the separator plate central opening 204. In certain embodiments, the axially-extending outer wall 208 abuts an unmachined inner surface 211 of the housing 12. As used in this application, the term "unmachined", as used herein, refers to a condition of the separator plate 30 or housing inner surface 211 in which no material has been removed by any of the manufacturing processes used in the forming, shaping, drawing, or finishing of the separator plate 30 or housing inner surface 211. Consistent with this terminology, the term "machined", as used herein, refers to a condition of the separator plate 30 or housing inner surface 211 in which material has been removed by at least one of the manufacturing processes used in the forming, shaping, drawing, or finishing of the separator plate 30 or housing surface 211. It should also be noted that the use of the term "unmachined", as used herein with respect to the separator plate 30, refers to processing of the separator plate 30 after the initial trimming and/or piercing of the metal blank. This initial "trimming" and "piercing" may be used to create the central opening 204 of the separator plate blank member 240, and to set the outer perimeter for the separator plate blank member 240, and typically involves operations that run substantially parallel to the thickness of the blank material. The aforementioned "trimming" and "piercing" may be carried out using a variety of processes, including, but not limited to, cutting, sawing, shearing, stamping, punching, torching, laser cutting, etc.

With respect to the assembly of the scroll compressor assembly 10, in certain embodiments, the separator plate 30 is attached by any suitable means (e.g., welding, mechanical fastener, interference fit, adhesives, etc.) to the unmachined inner surface 211 of the housing 12. For example, the central hub 205 of the fixed scroll compressor body 110 is inserted into the central opening 204 of the separator plate 30. In a specific embodiment, this assembly involves assembling the separator plate 30 onto the fixed scroll compressor body 110.

In certain embodiments, an O-ring 213 is assembled to the central hub 205 of the fixed scroll compressor body 110 before insertion into the central opening 204 of the separator plate 30. The O-ring 213 creates a seal between the fixed scroll compressor body 110 and the axially-extending curved inner wall 206 of the separator plate 30.

The design of the axially-extending curved inner wall 206 eases the insertion of the fixed scroll compressor body 110 and its O-ring 213 into the central opening 204, without any machining the separator plate 30 after blanking. In many cases, these components are assembled by hand in such a manner that they may be misaligned as the central hub 205 of the fixed scroll compressor body 110 is introduced into the separator plate central opening 204. The shape of the axially-extending curved inner wall 206 allows for this misalignment without damaging either the fixed scroll compressor body 110, the separator plate 30, or the O-ring 213.

In order to create a round finished separator plate 30 from rectangular prismatic stock such as sheet, roll, or strip, an annular blank member must be created. In order to achieve a finished part with a central cylindrical bore 204, the blanking process typically also includes the creation of an initial hole as part of the blanking process. The creation of these blank inner- and outer-diameters may be performed as a first step in the flat stock, or may be conducted on a semi-finished part, at a more convenient point in the manufacturing process, but prior to creating the axially extending curved inner wall 206 and axially-extending curved outer wall 208, respectively.

Figure 7:
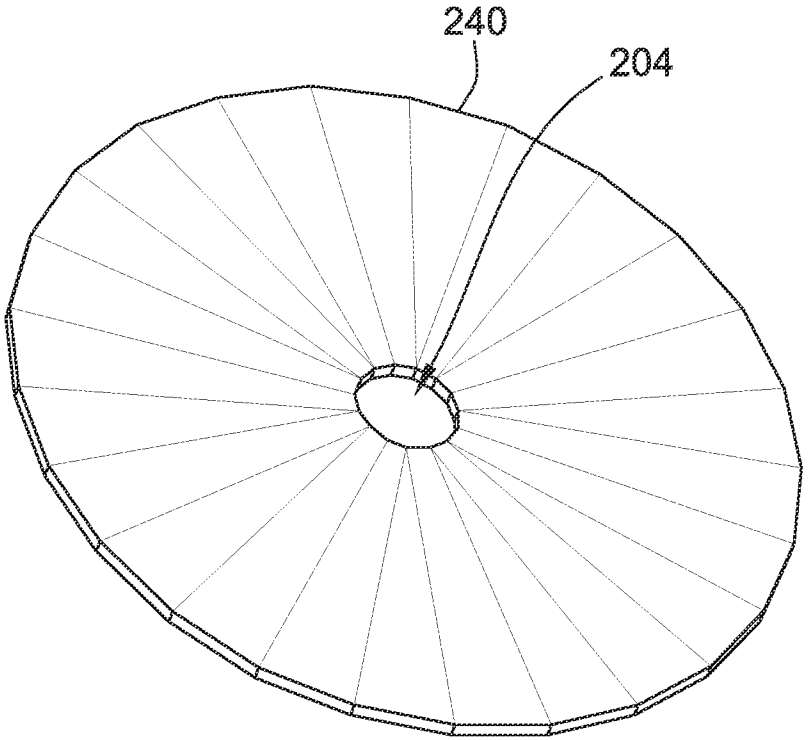
FIG. 7 is a perspective view of an annular member prior to shaping and forming steps, according to an embodiment of the invention.

Referring again to FIGS. 5 and 6, in an exemplary manufacturing process, the separator plate 30 is manufactured using one or more blanking operations to set the inner and outer diameters of the part, referred to as piercing and trimming respectively. The trimming operation may include, for example, shearing, laser cutting, flame cutting, or other similar processes. The piercing step could similarly involve shearing, laser cutting, or flame cutting, or any metal cutting process suitable for creating a central opening such as drilling, etc. For example, the separator plate 30 may be fabricated by manufacturing a flat metal blank of substantially constant thickness. The metal blank is formed into an annular member 240, such as shown in FIG. 7. In a particular embodiment, the outer diameter and the inner diameter of the annular member are formed simultaneously by the blanking operation, which results in an initial central bore 204 whose inner diameter is precisely aligned with the outer diameter. In alternate embodiments, the central opening and outer diameter could be created by two different operations performed sequentially or at different times in the manufacturing process. One advantage of the simultaneous blanking operation is that the process often results in a radial position of the inner and outer diameters that is controlled more precisely than it would be in some process in which they are formed separately, or a process in which one section is clamped while the other section is machined. Further, the simultaneous blanking method of the present invention typically results in faster production and lower cost due to the elimination of machining steps. In certain embodiments, stamping a flat metal blank of substantially constant thickness is done on a hard tool configured to restrain movement of the flat metal blank.

Figure 8:
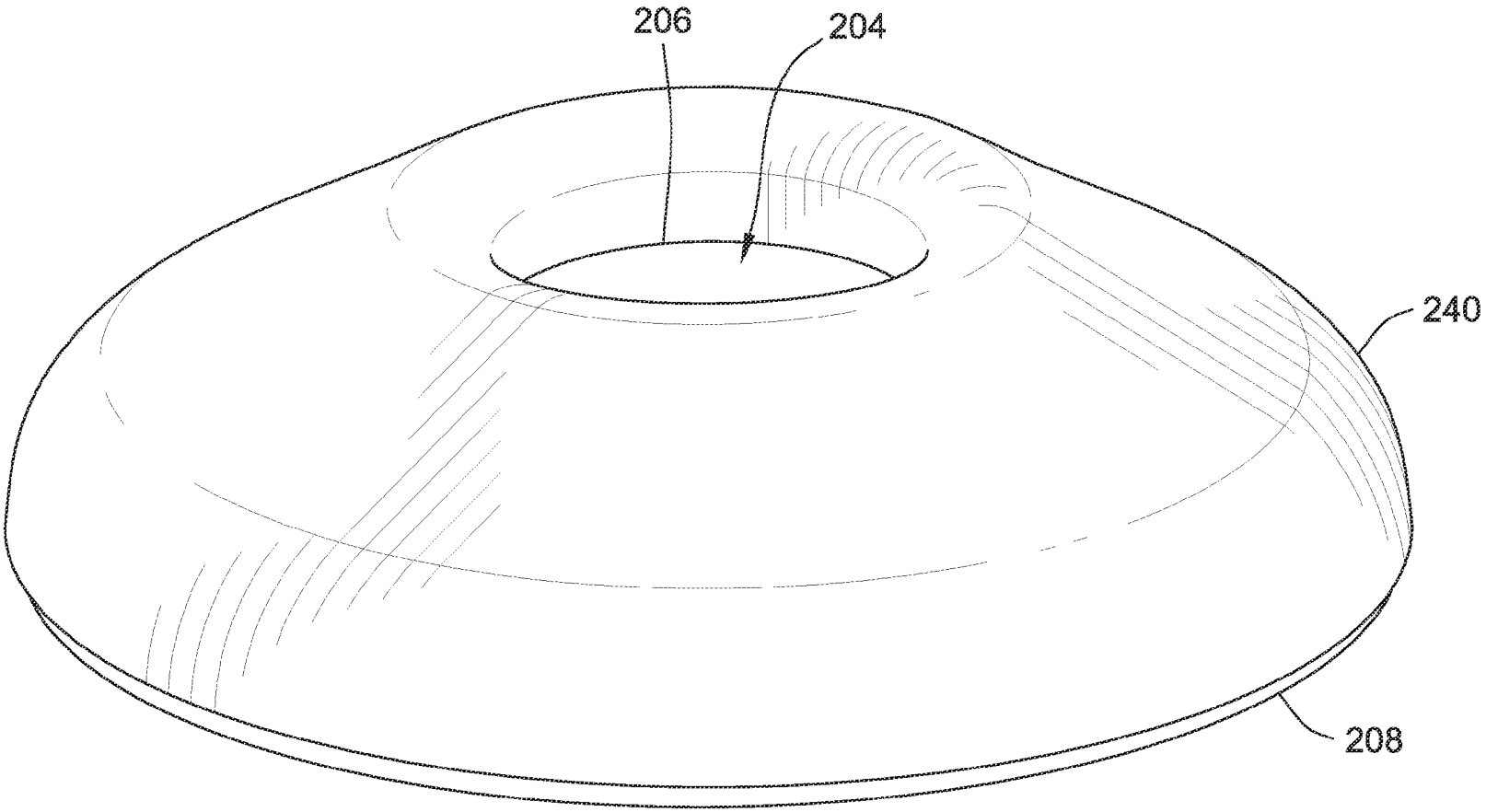
FIG. 8 is a perspective view of the annular member after the shaping and forming steps, according to an embodiment of the invention.

Following the above-described trimming and piercing steps, the annular member 240 undergoes additional shaping and forming steps to give the annular member 240 a frustoconical shape with axially-extending curved inner wall 206 and axially-extending curved outer wall 208, as shown in FIG. 8. As explained above, the central opening 204 could be created before or after the above-described shaping and forming steps. As also explained above, the shaping and forming steps, along with any subsequent finishing steps used in the manufacture of the separator plate 30, are non-material-removal steps in which no material is removed from the annular member 240.

The process is designed such that the stamping and subsequent forming operations achieve adequate true position of the separator plate 30 during a press-fit assembly, and provides for an acceptable amount of radial position stackup between the assembled parts of the compressor assembly 10. As such, no surface of the separator plate 30 requires machining and the separator plate maintains a substantially constant thickness throughout. This process also works in concert with an unmachined top shell 26 of the housing 12, allowing the separator plate 30 to be press-fit and welded into the unmachined housing 12.

As stated, there are no machined surfaces on the separator plate 30, which has a substantially constant thickness throughout. The elimination of machining steps to fix the inner and outer diameters means that there is no localized thinning of the part thickness. This helps maintain the material integrity of the separator plate 30, but also allows for a thinner stock to be employed and still meet the minimum thickness requirements for the separator plate 30, thus further reducing the manufacturing cost. In the context of the present invention and of the embodiments both envisioned and described herein, a "substantially constant" thickness is one in which the maximum thickness in any part of the separator plate 30 is no more than 40% greater than the minimum thickness in any part of the separator plate 30 due to localized thinning and thickening resulting from the forming process. Preferably, the "substantially constant" thickness is one in which the maximum thickness in any part of the separator plate 30 is no more than 20% greater than the minimum thickness in any part of the separator plate 30, due to localized thinning and thickening resulting from the forming process. In a typical embodiment, the separator plate 30 has a thickness between 2.5 and 10.0 mm. This 2.5 to 10.0 range is a range for the nominal overall thickness of the separator plate 30 and does not speak at all to any variability in the thickness of the separator plate 30. For example, a separator plate 30 with a nominal thickness of 5 mm may have a maximum and minimum thickness that varies by 20% will have a minimum thickness of 4 mm and a maximum thickness of 6 mm.

Further, in some embodiments of the invention, the "substantially constant thickness" may call for a maximum thickness that is at least 10% greater than the minimum thickness due to the aforementioned localized thinning and thickening that results from the forming process. However, in a preferable embodiment, the "substantially constant thickness" is one in which the maximum thickness of the separator plate 30 is at least 5% greater than the minimum thickness.

During the manufacture of a particular embodiment, a die is inserted from the bottom of the central opening 204, generating this curve at flared entrance point 209. This curvature allows for relatively severe positional misalignment of the separator plate 30, relative to the fixed scroll compressor body 110 during manufacture, such as might occur during manual assembly. As the central hub 205 and separator plate 30 are assembled, the central hub 205 of the fixed scroll compressor body 110 progresses from the widest portion of the central opening 204 at flared entrance point 209 to a relatively narrower cylindrical portion 215. Consequently, the geometry of the axially-extending curved inner wall 206 centers the fixed scroll compressor body 110 relative to the separator plate 30.

The cylindrical portion 215 of the axially-extending curved inner wall 206 forms a sealing section due to its engagement with O-ring 213. This cylindrical portion 215 is delimited along a bottom thereof by an outward flare, i.e., the flared entrance point 209, terminating at an inner annular end surface 216, and further delimited along a top portion thereof by a curved annular nose region 218 that merges into an annular wall comprising a frusto-conical connecting annular wall portion 220 that joins to the axially-extending curved outer wall 208.

The separator plate 30 includes a first surface 228 and a second surface 230 with a substantially constant thickness defined therebetween. The first and second surfaces 228, 230 extend radially inward from an outer annular end surface 224 toward an inner annular end surface 216, the outer and inner annular end surfaces 224, 216 each joining the first and second surfaces 228, 230 and extending transversely between the first and second surfaces 228, 230 a distance that is equal to the substantially constant thickness. In particular embodiments, the cylindrical portion 215 of the axially-extending curved inner wall 206 includes a cylindrical sealing section having a surface finish, or surface roughness of between 0.2 and 1.0 μm Ra. In many cases, a very smooth surface finish is costly and difficult to obtain with a lathe-turned part. Thus, the ability to achieve a good seal without such costly machining can result in substantial savings in cost and manufacturing time.

In certain embodiments, the process for manufacturing the separator plate 30 includes an additional forming or shaping operation on both the inner and outer diameters of the separator plate 30. This forming or shaping operation serves as a non-material-removal finishing step, such as burnishing or ironing, that achieves a high-quality surface finish without the removal of any surface material, and may produce a non-abrasive surface as low as 0.6 μm Ra on both inner and outer diameter sections, which, in addition to being faster and less expensive, is better than many typical high volume machining operations. More generally, the aforementioned non-material-removal finishing step results in a separator plate 30 that includes an innermost diameter defined by the aforementioned cylindrical sealing section with an inner sealing surface having a surface roughness of less than 1.0 μm Ra. In a further embodiment, the outer perimeter portion of the separator plate 30 has the axially-extending curved outer wall 208 with a surface roughness of less than 1.0 μm Ra. Some embodiments may have a cylindrical portion 215 with a circularity of 0.15 mm or more, which may be substantially more than a machined component of similar scale. The process described herein, i.e., the simultaneous formation of the central bore that forms the inner diameter, and of the outer diameter, which allows for the central opening 204 to be positioned with such precision that some error in circularity can be tolerated.

In the embodiments shown, the frusto-conical connecting annular wall portion 220 extends radially between the curved annular nose region 218 and the axially-extending curved inner wall 206. The axially-extending curved outer wall 208 extends vertically below the frusto-conical wall portion 220. The outer annular end surface 224 is at least partially covered by an annular weld 226 that joins the housing and the separator plate 30.

The method also requires assembling the axially-extending curved inner wall 206 to a central hub of one of the scroll compressor bodies, and attaching the axially-extending curved outer wall 208 to an unmachined inner surface 211 of the housing shell 12.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of manufacturing a scroll compressor comprising:

assembling scroll compressor bodies having respective bases and respective scroll ribs that project from the respective bases and which mutually engage about an axis for compressing fluid;

assembling a housing shell section over the scroll compressor bodies;

constructing a separator plate, wherein constructing a separator plate comprises:

piercing an inner portion of a metal blank of substantially constant thickness and trimming a perimeter portion of the metal blank, to form an annular member;

forming the annular member into a frusto-conical shape having an axially-extending curved outer wall, and a central opening having an axially-extending curved inner wall;

wherein no surface of the annular member is machined;

assembling the axially-extending curved inner wall to a central hub of one of the scroll compressor bodies;

press-fitting the separator plate into the housing; and attaching the axially-extending curved outer wall to an unmachined inner surface of the housing shell section.

2. The method of claim 1, wherein attaching the axially-extending curved outer wall to the unmachined inner surface of the housing shell section comprises welding the axially-extending curved outer wall to the unmachined inner surface of the housing shell section.

3. The method of claim 1, wherein forming a central opening having an axially-extending curved inner wall comprises forming a central opening having an axially-extending curved inner wall having a cylindrical portion.

4. The method of claim 1, wherein constructing a separator plate comprises constructing a separator plate having a substantially constant thickness.

5. The method of claim 1, wherein forming the annular member comprises forming the annular member with a substantially constant thickness between 2.5 and 10.0 mm.

6. The method of claim 1, wherein constructing a separator plate further comprises forming the axially-extending curved outer wall and the axially-extending curved inner wall using a non-material-removal finishing operation.

7. The method of claim 1, wherein the piercing step and the trimming step are performed simultaneously by stamping the metal blank to form the annular member such that an outer diameter and an inner diameter of the annular member are formed simultaneously by the stamping operation.

8. The method of claim 7, wherein stamping the metal blank to form the annular member such that the outer diameter and the inner diameter of the annular member are formed simultaneously comprises stamping the metal blank on a hard tool configured to restrain movement of the metal blank.

9. The method of claim 1, wherein the piercing step is performed after the forming of the annular member into a frusto-conical shape.

10. A method for manufacturing a separator plate having no machined surfaces, the separator plate used in a scroll compressor, the method comprising:

piercing an inner portion of a metal blank of substantially constant thickness and trimming a perimeter portion of the metal blank, to form an annular member;

forming the annular member into a frusto-conical shape having an axially-extending curved outer wall, and a central opening having an axially-extending curved inner wall without machining; and shaping an outer periphery and an inner periphery of the annular member without machining;

wherein the formed annular member comprises a separator plate for a scroll compressor, the formed annular member having a substantially constant thickness.

11. The method of claim 10, wherein forming the annular member with a central opening having an axially-extending curved inner wall comprises forming the annular member with a central opening with an axially-extending curved inner wall having a cylindrical portion.

12. The method of claim 10, wherein forming the annular member comprises forming the annular member with a substantially constant thickness between 2.5 mm and 10.0 mm.

13. The method of claim 10, further comprising a forming operation in which a non-material-removal finishing operation is performed on the axially-extending curved outer wall and the axially-extending curved inner wall.

14. The method of claim 13, wherein the non-material-removal finishing operation comprises one of burnishing and ironing.

15. The method of claim 10, wherein the piercing step and the trimming step are performed simultaneously by stamping the metal blank to form the annular member such that an outer diameter and an inner diameter of the annular member are formed simultaneously by the stamping operation.

16. The method of claim 15, wherein stamping the metal blank to form the annular member such that the outer diameter and the inner diameter of the annular member are formed simultaneously comprises stamping the metal blank on a hard tool configured to restrain movement of the metal blank.

17. The method of claim 10, wherein the shaping step is performed subsequent to the forming step.

* * * * *